United States Patent [19]

Wedge

[11] Patent Number: 4,699,038

[45] Date of Patent: Oct. 13, 1987

[54] TOUCH SENSITIVE ELECTRONIC MUSICAL OR SOUND GENERATING INSTRUMENT

[75] Inventor: D. Scott Wedge, Santa Cruz, Calif.

[73] Assignee: E-Mu Systems, Inc., Scotts Valley, Calif.

[21] Appl. No.: 869,006

[22] Filed: May 30, 1986

Related U.S. Application Data

[63] Continuation-in-part of Ser. No. 740,081, May 31, 1985, abandoned.

[51] Int. Cl.[4] ..... G10H 1/02; G10H 1/06; G10H 1/46

[52] U.S. Cl. ..... 84/1.1; 84/1.19; 84/1.26; 84/1.27; 84/DIG. 7

[58] Field of Search ..... 84/1.09–1.13, 84/1.19–1.27, DIG. 7

[56] References Cited

U.S. PATENT DOCUMENTS

| | | | |
|---|---|---|---|
| 2,888,849 | 6/1959 | Humphrey et al. | 84/DIG. 7 |
| 4,416,178 | 11/1983 | Ishida | 84/1.1 |
| 4,493,237 | 1/1985 | DeLong et al. | 84/1.26 |
| 4,627,325 | 12/1986 | Kaneko | 84/1.26 |
| 4,633,750 | 1/1987 | Sakai | 84/1.1 |
| 4,655,114 | 4/1987 | Sunada | 84/1.1 X |

*Primary Examiner*—Stanley J. Witkowski
*Attorney, Agent, or Firm*—Flehr, Hohbach, Test, Albritton & Herbert

[57] ABSTRACT

A touch sensitive electronic musical or sound generating instrument is disclosed. The invention utilizes digital techniques to sense how hard any one of a plurality of push buttons on a keyboard is depressed or actuated. The instrument generates a desired or particular sound (such as a musical note) at a desired parameter such as volume, corresponding to how hard a specific button was depressed.

10 Claims, 7 Drawing Figures

TOUCH SENSITIVE ELECTRONIC MUSICAL OR SOUND GENERATING INSTRUMENT

This is a continuation-in-part of application Ser. No. 740,081, filed May 31, 1985 and now abandoned.

BACKGROUND OF THE INVENTION

The present invention relates to a touch sensitive electronic musical or sound generating instrument. Electronic musical instruments such as keyboard type instruments have long been known for generating musical sounds corresponding to actuation of one or more keys on the keyboard. The desired note or sound corresponds to depression of a particular key and the loudness or other parameter of the sound corresponds in some fashion to how hard the particular key or keys were depressed.

In instruments known as polyphonic type instruments, several sounds can be created simultaneously. With polyphonic keyboard type instruments, it is desirable to detect how hard each push button or key was actuated or depressed in order to generate a musical sound or tone having a specified volume level or other parameter corresponding to how hard the respective key or botton was depressed.

In one approach, the prior art provides two switches per button or key, which are sequenced such that by measuring the time between switch closures, the button velocity can be determined. This approach requires accurate physical switch sequencing and fast scanning times. A second approach in the prior art is where each button or key is provided with an analog pressure sensor. The key or button that is struck measures pressure. Continuous pressure can also be used to modulate the desired sound. This second approach requires analog multiplexing equipment and expensive push buttons. A further problem with the second approach is the wear and tear on the push buttons.

A third approach is where a vibration sensor is provided for each key or button. In this third approach, the button directly strikes a vibration sensor. As with the second approach described above, this requires expensive buttons, and an analog multiplexer. Also, crosstalk between buttons can degrade performance.

A fourth approach is in monophonic equipment, where only one sound is played at a time. With only one sound generated at one time, only one button is actually used. The problem with this approach is generation of only one sound (as contrasted with polyphonic equipment) and in addition, crosstalk can be a detrimental factor.

SUMMARY OF THE INVENTION

It is an object of the present invention to provide an improved touch sensitive electronic musical or sound generating instrument.

It is a further object of the present invention to provide a touch sensitive electronic musical or sound generating instrument that can be utilized with polyphonic type instruments.

The present invention includes a plurality of push buttons and button interface means responsive to actuation of any one of the plurality of push buttons for generating a first control signal representative of a particular sound parameter to be generated.

The instrument also includes a single vibration sensor means responsive to depression or actuation of any one of the push buttons for generating a second control signal representative of how hard any one of the push buttons was in fact actuated or depressed.

The instrument also includes processor means responsive to the first and second control signals for generating a third control signal representative of the particular sound parameter to be generated and how hard any one of the push buttons was in fact actuated. As indicated above, the desired parameter could be the volume, pitch, timbre, attack time, modulation and the like.

In view of the foregoing, the present invention achieves the objective of providing an improved touch sensitive electronic musical or sound generating instrument.

Other objects and features of the present invention will become apparent from the following detailed description when taken in conjunction with the accompanying drawings.

DETAILED DESCRIPTION OF THE DRAWINGS

Figure 1:
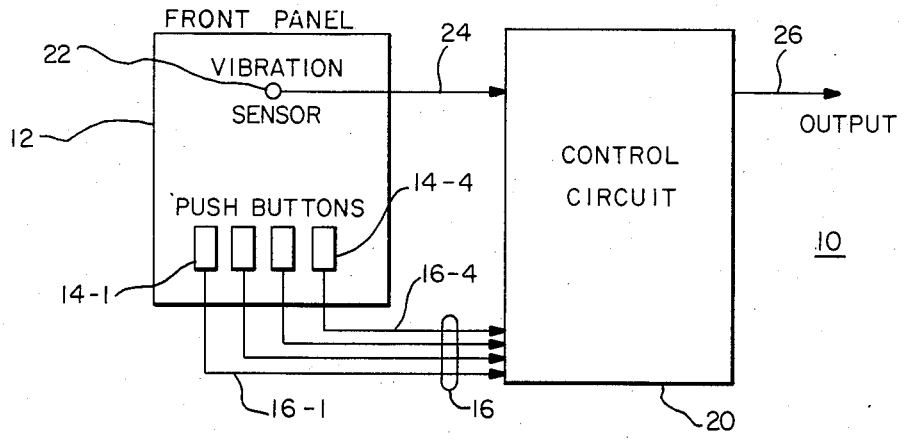
FIG. 1 depicts a block diagram of a touch sensitive electronic or musical or sound generating instrument according to the present invention.

Referring now to FIG. 1, a block diagram of the touch sensitive electronic instrument is depicted. The instrument 10 could be utilized for musical or any other sound generating instrument, such as a polyphonic keyboard type instrument, an electronic organ, electronic drum sound instruments, or any other sound generating instrument. In one application, the present invention provides the capability of sensing a plurality of keys or push buttons which are depressed and producing a distinct sound, pitch, timbre, attach time and the like. For purposes of discussion, it will be assumed that the invention is utilized to provide a parameter representative of a sound to be generated and the desired volume of that sound.

In FIG. 1, the instrument 10 includes a front panel 12 in a typical fashion. The front panel 12 provides for a plurality of push buttons or keys, as illustrated by push buttons 14-1 through 14-4. Although four push buttons are shown in FIG. 1, it should be understood that the present invention would be applicable to any type of keyboard instrument having a large number of keys or push buttons.

Each push button 14 has corresponding lead or bus 16, such as lead 16-1 for push button 14-1. The signals on combined leads 16 constitute first control signals which are input to control circuit 20, the details of which will be described in conjunction with FIG. 2.

In FIG. 1, the front panel 12 includes a vibration sensor 22, which generates a signal on lead 24 for input to control circuit 22. Vibration sensor 22 is provided to determine how hard one of the push buttons 14 is actuated or depressed. Vibration sensor 22 provides a corresponding second control signal on lead 24 which is representative of how hard any one of the push buttons 14 has in fact been depressed or actuated. A single vibration sensor means is all that is required for sensing how hard any one of the plurality of push buttons 14-1 through 14-4 has been depressed.

Control circuit 20 is responsive to the first and second signals on leads 16 and 24, and provides on lead 50 an output signal which is representative of the particular sound to be generated (such as a musical note) and, in addition, corresponds to the specified or desired volume of the particular sound. This specified volume corresponds to how hard any one of the push buttons 14 was in fact actuated. Of course, the desired parameter could be the pitch, timbre, or other desired parameter, as described above.

In a preferred embodiment of this invention, a single vibration sensor is utilized to detect how hard a push button is depressed. The sensor 22 is used to determine an amplitude (or other) parameter of sound generated in response to the depression of push button 14.

In the particular application of the present invention, if two of the buttons 14-1 through 14-4 are depressed simultaneously, it is presumed for purposes of operation that the button pushed hardest is the specified or desired output volume for the respective sounds to be generated.

Figure 2:
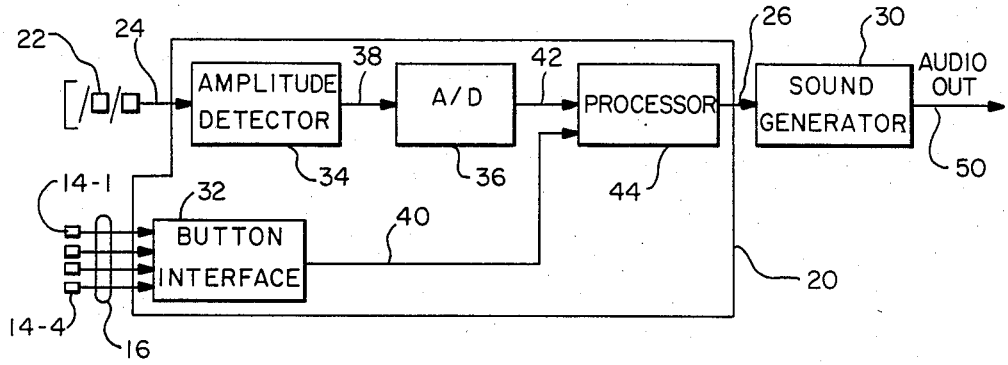
FIG. 2 depicts a more detailed block diagram of the present invention as illustrated in FIG. 1.

Referring now to FIG. 2, a more detailed diagram of the present invention depicted in FIG. 1 is illustrated. In FIG. 2, the push buttons 14 are shown connected to a button interface circuit 32. The purpose of button interface circuit 32 is to provide a control signal on lead 40. The control signal on lead 40 could be a parallel format signal where each push button 14 is scanned by a microprocessor, such as processor 44.

Actuation of any one of the plurality of push buttons 14 will result in button interface 32 being responsive thereto in order to generate a first control signal on lead 40 which is representative of a particular sound to be generated (such as a musical note and the like).

In FIG. 2, the vibration sensor 22 provides an analog signal on lead 24 for input to amplitude detector 34. In one embodiment, the vibration sensor 22 includes a conventional piezo electric crystal assembly. Amplitude detector 34 provides another signal on lead 38 which is representative of the peak amplitude corresponding to how hard a respective one of the buttons 14 was depressed. This signal on lead 38 is converted by analog to digital converter (A/D) 36, which generates a digital signal 42 which is representative of how hard a particular one of the push buttons was depressed or actuated. In one embodiment, processor 44 is scanning the push buttons 14 and will detect when any one of the push buttons is actuated. Hence, the digital signal 42 corresponds to the first signal 40.

The signals 40, 42 are input to processor 44 (typically a Z-80 microprocessor), which is responsive to the first and second control signals for generating a third control signal on lead 26, which is representative of, for example, the particular sound to be generated, including the specified volume of the particular sound. The specified volume corresponds to how hard any one of the particular push buttons 14 of FIGS. 1 and 2 were in fact actuated or depressed.

The instrument in FIG. 2 also includes a sound generator 30, which could be connected to a suitable speaker of sufficient audio fidelity and which is responsive to the signal on lead 26 for generating an audio output 50. The output 50 from sound generator 30 could also be the actual audio sound being generated by sound generator 30 at the desired volume level, corresponding to how hard the specified push button 14 of FIGS. 1 and 2 was depressed or actuated.

The output signal on lead 26 from processor 44 could also be an analog signal for connection to sound generator 30. This would be another embodiment of the present invention where the high quality audio speaker were connected directly to the processor 44.

Figure 3:
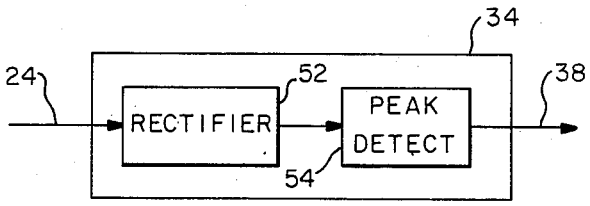
FIG. 3 depicts a block diagram illustrating vibration sensing of th present invention.
Figure 4:
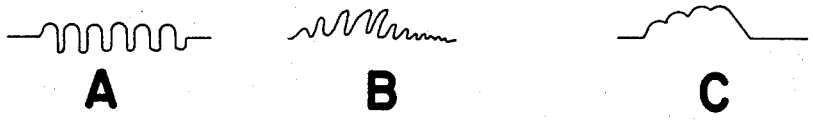
FIGS. 4A, 4B and 4C depict diagrams illustrating vibration detection amplitudes of FIG. 3.

Referring to FIG. 3, a more detailed block diagram of the amplitude detector circuit of FIG. 2 is depicted. The amplitude detector 34 is responsive to a signal on lead 24 from the vibration sensor. FIG. 4A depicts the level of the signal on lead 24 which is input to rectifier 52 of FIG. 3.

FIG. 4B illustrates the rectified signal from rectifier 52, which is input to peak detect circuit 54, which detects the peak amplitude of the signal on lead 24. This peak signal is illustrated in FIG. 4C and corresponds to how hard a particular push button or key of FIGS. 1 and 2 was in fact depressed or actuated.

As can be seen in FIGS. 3 and 4A, 4B and 4C, the vibration sensor and amplitude detector illustrate that hitting a particular button harder causes a larger amplitude vibration, and hence higher signal levels. This can be sensed by the circuitry of the present invention to provide a reliable indication of how hard a particular key or push button 14 has been depressed.

Figure 5:
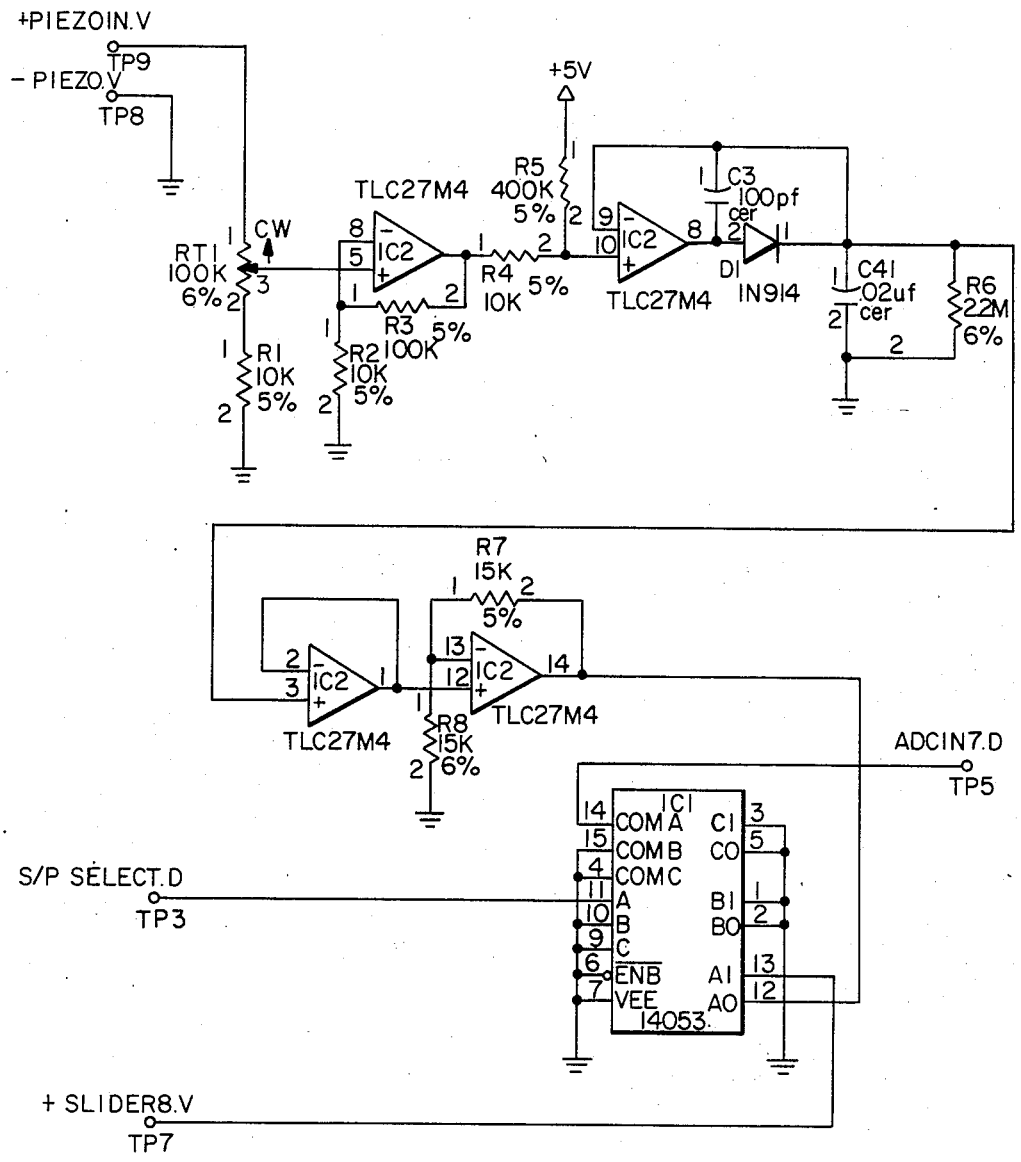
FIG. 5 depicts a schematic diagram of a portion of the vibration sensing means of the present invention.

FIG. 5 depicts a schematic diagram illustrating the details of the amplitude detector 34 of FIG. 2. The drawing of FIG. 5 includes a conventional quad operational amplifier (IC2) and a CMOS analog switch (IC1).

Referring now to FIG. 5, the schematic details of the amplitude detector 34 of FIG. 2 (which forms part of the vibration sensor means) are shown connected to receive the piezo electric signal (on lead 24), which is input to test points TP9, TP8. The following description should also be taken in conjunction with FIGS. 3 and 4.

In FIG. 5, the piezo signal is input to a resistive attenuator comprising RT1 and R1. The adjustment of RT1 determines any unit to unit variation in the piezo crystals and the way they are mounted, so that the signal can be trimmed to an exact response of a particular piezo crystal.

The output of RT1 is input to an amplifier comprising IC2 (pins 5, 6, 7) and resistors R2, R3. The output of pine 7, IC2 is a fairly high level signal which is attenuated so that the signal level is known.

Resistors R4, R5 provide a level shifting circuit to make sure that the average level of the output of IC2, pin 7 is slightly above ground when no signal is present.

It is desired to have the output of IC2 to forward bias diode D1 under all circumstances to avoid ending up with a slow response time. Thus, resistors R4, R5 cause pin 10 of IC2 to be slightly positive with respect to pin 9 in a quiescent condition. This means that the output, pin 8 of IC2, will be one diode drop above ground and diode D1 will be turned on.

Diode D1 is acting as a rectifier in that as a signal appears on pin 10 of IC2, diode D1 provides a positive current into pin 1 to capacitor C41 and resistor R6.

When the signal goes negative, the output of IC2, pin 8, becomes negative and does not conduct through diode D1.

Hence, diode D1 is an active rectifier in the loop with IC2.

The peak detector 54 of FIG. 3 comprises C41 and R6, which is a high impedance point for amplifier IC2.

Pins 1, 2 and 3 of IC2 provide a unity gain buffer to enable the driving of the analog to digital converter 36 of FIG. 2. Pins 12, 13 and 14 of IC2 provide an amplifier to provide for the proper level for a specified A/D converter.

The first section of IC2 (pins 5, 6 and 7) provide a voltage buffer or amplifier, and pins 8, 9 and 10 of IC2, in conjunction with diode D1, provide the rectifier portion 52 of FIGS. 4A, 4B and 4C. The peak detection 54 of FIGS. 3, 4A, 4B and 4C is provided by capacitors C41 and resistor R6, and buffered by IC2 pins 1, 2 and 3.

The output of pin 14, IC2 of FIG. 5, could be connected to the A/D converter 36 of FIG. 3. Depending upon a particular application, the output of pin 14, IC2, could be switched through a conventional analog switch (14053) for connection to a conventional A/D converter depending on particular applications.

The preferred embodiment provides for digital scanning to sense actuation or depression of a plurality of push buttons with a single vibration sensor. This provides for a wide dynamic range with low cost in terms of components. With a digital implementation, a long lifetime is expected.

Other improvements over the prior art is that, with this implementation, crosstalk problems are eliminated. The present invention is capable of slow scanning or proportional scanning of the push buttons to provide a reliable indication of the sound to be generated and, in addition, the volume desired for the respective sound.

The present invention is suitable for monophonic and, effectively, polyphonic applications. Even if two buttons hit simultaneously with different hardness, an acceptable compromise is available. It is considered in a preferred embodiment that when two buttons are hit simultaneously with different hardness, each button is considered to have been hit equally hard. As indicated, this is an acceptable compromise, especially if the instrument is a sequencer.

As previously described, the present invention senses a plurality of keys or push buttons to produce a desired sound, pitch, timbre or other desired parameter. Although one preferred embodiment of the present invention has been shown and described in conjunction with the accompanying drawings, it should be understood that other variations of the present invention are possible. Therefore, the scope of the present invention should only be construed in conjunction with the accompanying claims.

What is claimed is:

1. A touch sensitive electronic musical or sound generating instrument comprising a plurality of push buttons, button interface means responsive to actuation of any one of said plurality of push buttons for generating a first control signal representative of a specified sound parameter to be generated when said one push button is actuated, a single vibration sensor means for all of said plurality of push buttons, said single vibration sensor means responsive to the actuation of said any one of said plurality of push buttons for generating a second control signal representative of how hard said any one of said push buttons was actuated, where said second signal corresponds to said first signal, said vibration sensor means including an amplitude detector means for detecting how hard any one of said push buttons was actuated where said amplitude detector means generates said second control signal corresponding to how hard said push button was actuated, processor means responsive to said first and second control signals for generating a third control signal representative of said specified sound parameter to be generated, and representative of how hard said any one of said push buttons was actuated.

2. An instrument as in claim 1, including sound generator means responsive to said third control signal for generating the particular sound in accordance with said specified parameter.

3. An instrument as in claim 1 wherein said specified parameter is volume.

4. An instrument as in claim 1 wherein said specified parameter is timbre.

5. An instrument as in claim 1 wherein said specified parameter is attack time.

6. An instrument as in claim 1 wherein said specified parameter is pitch.

7. An instrument as in claim 1 wherein said specified parameter is modulation.

8. A touch sensitive electronic musical or sound generating instrument comprising a plurality of push buttons, button interface means responsive to actuation of any one of said plurality of push buttons for generating a first control signal representative of a specified sound parameter to be generated when said one push button is actuated, a single vibration sensor means for all of said plurality of push buttons, said single vibration sensor means responsive to the actuation of said any one of said plurality of push buttons for generating a second control signal representative of how hard said any one of said push buttons was actuated, where said second signal corresponds to said first signal, said vibration sensor means including an amplitude detector means for detecting how hard any one of said push buttons was actuated where said amplitude detector means generates said second control signal corresponding to how hard said push button was actuated, digital processor means responsive to said first and second control signals for generating a third control signal representative of said specified sound parameter to be generated and representative of how hard said any one of said push buttons was actuated, and sound generator means responsive to said third signal for generating said particular sound in accordance with said specified parameter.

9. A touch sensitive electronic musical or sound generating instrument comprising a plurality of push buttons, button interface means responsive to actuation of any one of said plurality of push buttons for generating a first control signal representative of a specified sound parameter to be generated when said one push button is actuated, a single vibration sensor means for all of said plurality of push buttons, said single vibration sensor means responsive to the actuation of any one of said plurality of push buttons for generating a second control signal corresponding to actuation of a specified one of said push buttons which is representative of how hard any one of said push buttons was actuated, where said second signal corresponds to said first signal, said vibration sensor means including an amplitude detector means for detecting how hard any one of said push buttons was actuated where said amplitude detector means generates said second control signal corresponding to how hard said push button was actuated, processor means responsive to said first and second signals for generating a third control signal representative of said specified sound parameter to be generated and representative of how hard said push buttons were actuated.

10. An instrument as in claim 9 including sound generating means responsive to said third control signal for generating said particular sounds at said specified parameter for the respective actuation of each of said push buttons.

* * * * *